United States Patent [19]

Morrison

[11] Patent Number: 4,518,210

[45] Date of Patent: May 21, 1985

[54] ZERO-INSERTION-FORCE HOUSING FOR CIRCUIT BOARDS

[75] Inventor: Robert A. Morrison, Long Beach, Calif.

[73] Assignee: Lockheed Corporation, Burbank, Calif.

[21] Appl. No.: 521,802

[22] Filed: Aug. 10, 1983

[51] Int. Cl.[3] ..... H01R 9/09

[52] U.S. Cl. ..... 339/17 LM; 339/75 MP; 339/176 MP

[58] Field of Search ..... 339/176 MP, 75 MP, 17 LM, 339/74 R

[56] References Cited

U.S. PATENT DOCUMENTS

| | | | |
|---|---|---|---|
| 3,129,990 | 4/1964 | Rice et al. | 339/17 LM |
| 3,173,732 | 3/1965 | James | 339/17 LM |
| 3,609,463 | 9/1971 | Laboue | 339/17 LM |
| 3,858,958 | 1/1975 | Davies | 339/17 LM |
| 3,920,030 | 11/1975 | Cutchaw | 339/75 MP |
| 4,386,815 | 6/1983 | Carter et al. | 339/75 MP |
| 4,451,818 | 5/1984 | Grabbe et al. | 339/75 MP |

*Primary Examiner*—John McQuade

*Attorney, Agent, or Firm*—Louis L. Dachs

[57] ABSTRACT

The invention is a circuit board housing assembly for electrically coupling at least one circuit board 30 to a mother board 22 mounted within the housing. The housing assembly incorporates at least one zero insertion force socket 26 having a plurality of electrical terminals 23 mounted therein and, further, is adapted to receive an edge portion 29 of at least one circuit board 30 which has a plurality of second electrical terminals 33 mounted thereon. An electrical connector 38 is mounted within the housing which includes a spring member 40 having a first end 41 terminating in a curved member 42 having a plurality of electrical contacts in slideable contact with the plurality of first electrical terminals of the socket mounted thereon. A cam assembly 64, 66 is mounted to the second end 60 of the spring member 40 and is adapted, when actuated, to force the plurality of electrical contacts into engagement with the plurality of second electrical terminals 33 no the circuit board 30 where maintaining electrical engagement with the plurality of first electrical terminals 23. In order embodiments, the socket is adapted to receive a pair of circuit boards and several configurations of the electrical connector are disclosed.

34 Claims, 13 Drawing Figures

FIG. 5
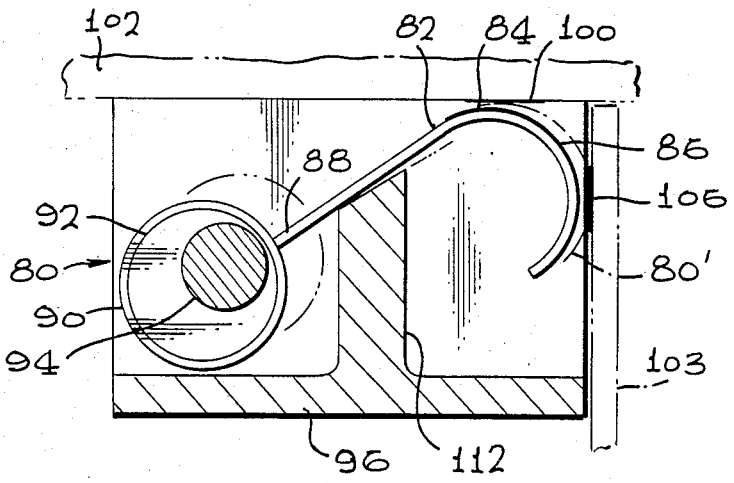
FIG. 6
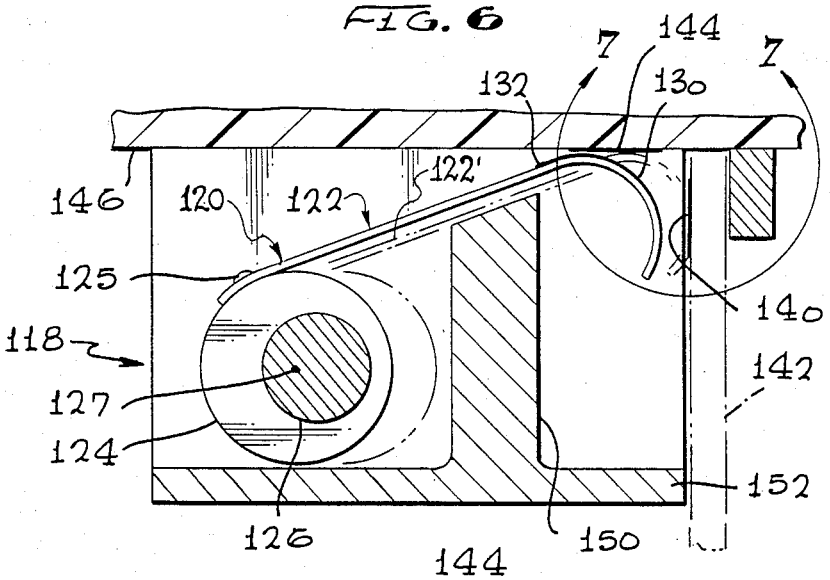
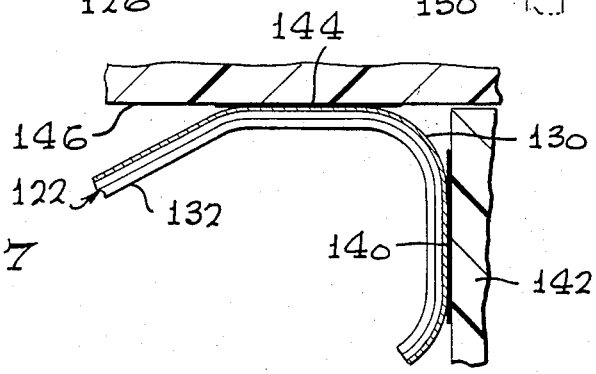
FIG. 7

FIG. 8
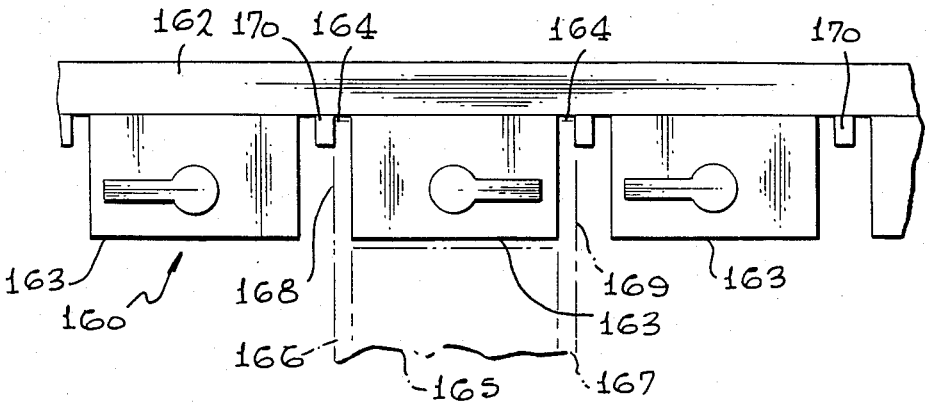
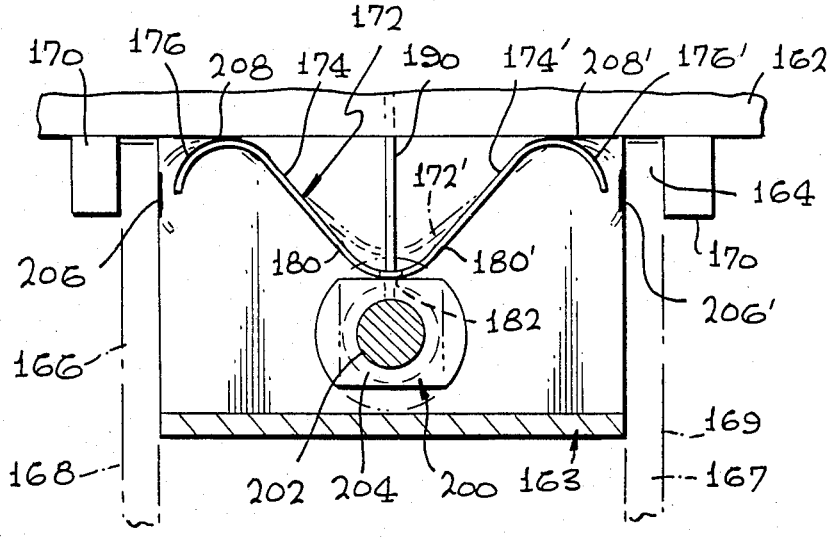
FIG. 9

ZERO-INSERTION-FORCE HOUSING FOR CIRCUIT BOARDS

TECHNICAL FIELD

The invention relates to the field of housings for connection of circuit boards to mother boards and in particular to housings having zero insertion force connectors.

BACKGROUND ART

In recent years, connector technology has not kept pace with the solid state circuit technologies. As the solid state chips have become capable of supporting more and more complicated circuit patterns, the input-output densities, (i.e., the final signal wires that are necessary to communicte one circuit chip to another usually given in the number of input-output circuits per cubic inch) are also increasing exponentially. As the density of input-output circuits increases, the maintenance and parts damage percentage have gone up and connectors have now become one of the least reliable components within electronic subsystems. For example, the interconnection from chip to chip carrier is accomplished using a 0.002 inch diameter wire and are more reliable than the connector pins.

To put the problem in perspective; during the vacuum tube era, where considerable power was required for the vacuum tubes, it was common practice to have the complete circuit subassembly serviced by a large cable with a relatively large connector with 1/16-inch diameter pins having to be mated. With the advent of circuit compression through solid state electronics these requirements have now arisen to a point where it is not uncommon for a connector to be required to make 200 to 400 contacts where the contacts are only 0.0030 inch in diameter. With this high density of small pins it is very easy to have one or more of the pins become deflected and/or mate improperly causing poor contact or making the connector unusable. This is why connector failures have become one of the dominate failure modes in avionics equipment.

The principal way of avoiding these pin chrunching connector mating operation is to use what is commonly called a zero insertion force (ZIF) connector. In this type of connector the pins and sockets are mated without any contact of the mating surfaces themselves so that there is very little mating force. With the two halves mated, a latch or cam mechanism is operated to engage all of the contacts and complete the circuit. These ZIF connectors have become very popular and sometimes very exotic.

The one major drawback with prior art designs is that since the connector is usually in the bottom of the housing into which the circuit boards are to be mated, it is very difficult to get to the connector to perform the latching operation.

Front panel operated ZIF connectors have eliminated this problem because the board or module can be inserted from the end of the connector rather than normal to it. This permits the end of the connector to be accessible from the open side of the electronics housing such that when the card or module is mated with the connector it is easy to reach the handle and operate the mating mechanism. Card edge front panel operated ZIF connectors are commercially available at this time, but their size and fabrication technique have not permitted a very high density of connections and they require a very large space for obtaining proper positioning and operation.

A second problem associated with the ZIF connector has to do with the very fine film that develops on contact surfaces from contamination, such as dirt, smoke, etc., which must be wiped off. On any connector it is necessary to have a finite wiping action so that the film is broken and metal surfaces are in intimate contact.

In the high denisty electronics that have been previously referred to, the design of the backplane or mother board becomes important. As the solid state devices used on the circuit boards have become more complicated and carry many more functions, they also have a large number of connections. This means that relatively small boards now may have as many as four hundred contacts per board that must be mated with the mother board. This high density of traces or terminals have required the use of multi-layer mother boards.

In some applications, particularly for military use, the mother boards have exceeded fifteen layers. The typical connectors used for mating of the subboards perforate the mother board like a picket fence. These piercing type connector terminals require a hole through all layers of the multi layer mother board and each of these holes must be plated through which requires very stringent quality controls.

Examples of this type of connector are disclosed in the following patents: U.S. Pat. No. 4,196,955, "Zero Insertion Force Connector," by John W. Anhalt; U.S. Pat. No. 3,793,609, "Low Insertion Force Printed Board Connector," by William McIver; U.S. Pat. No. 4,303,294, "Compound Spring Contact," by Wilbur A. Hamshere, Jr., et al; U.S. Pat. No. 4,261,631, "Connector for Printed Circuit Board," by Bernard Guilcher, et al; U.S. Pat. No. 3,977,747, "Zero Insertion Force Connector," by Kamal Shawiky Broutros; and U.S. Pat. No. 3,665,370, "Zero-Insertion Force Connector," by Karl Wilhelm Hartmann. Note that in all of these patents the mother board terminals also act as the locking means for the circuit board and the mother board is pierced by the terminals.

Therefore, it is a primary object of this invention to provide a housing for connecting circuit boards to a mother board wherein the circuit board can be installed with zero insertion force.

It is another object of this invention to increase the allowable electrical terminal contact density for a housing adapted to connect circuit broads with a mother board.

Another object of this invention is to provide a housing for connecting circuit boards to a mother board with zero insertion force and providing front panel locking of the circuit boards therein.

A further object of this invention is to provide a housing for connecting circuit boards to a mother board wherein the mother board is not pierced by electrical terminals, i.e. surface mounted.

A still further object of this subject invention is to provide a housing for connecting circuit boards to a mother board wherein the electrical connector wipes and cleans off the electrical terminals on both the mother board and circuit board ensuring good electrical contact upon the connection of the circuit board terminals to the mother board terminals.

DISCLOSURE OF THE INVENTION

The invention is a circuit board assembly for electrically coupling at least one circuit board to a mother board mounted within the housing. The housing assembly incorporates at least one zero insertion force socket having a plurality of first electrical terminals mounted therein. The at least one socket is adapted to receive an edge portion of at least one circuit board. The at least one circuit board incorporates a plurality of second electrical terminals mounted thereon. The circuit board is mounted in the socket in such a manner the plurality of first electrical terminals is at substantially right angles to the plurality of second electrical terminals on the motherboard.

An electrical connector is provided within the housing which comprises a spring member having first and second ends. The first end terminates in a curved member having at least one electrical contact mounted thereon. A plurality of electrical contacts are in slidable engagement with the plurality of first electrical terminals of the socket.

A cam means is mounted on the second end of the spring member so as to cause the spring member to maintain the plurality of electrical contacts in slideable engagement with the plurality of first electrical terminals in the socket. The cam means is further adapted, when actuated, to force the plurality of electrical contacts into engagement with the plurality of second electrical terminals on the circuit board while maintaining electrical engagement with the plurality of first electrical terminals.

In another embodiment, at least one zero insertion force socket has first and second sets of electrical terminals in a spaced relationship with each set having a plurality of electrical terminals thereon. The at least one socket is adapted to receive the edge portions of first and second circuit boards also in a spaced relationship. Each of the circuit boards incorporates a plurality of electrical terminals.

The mounting of the circuit boards is in such a manner that when the circuit boards are installed the first set of electrical terminals is at substantially right angles to the plurality of electrical terminals on the first circuit board and the second set of electrical terminals is at substantially right angles to the plurality of electrical terminals on the second circuit board. In this embodiment, a pair of spring members are mounted between the first and second sets of terminals. The first ends of each of the spring members are coupled together and the second ends of the first and second spring members terminate in first and second curved members, respectively. The first and second curved members incorporate a plurality of electrical contacts in slideable engagement with the plurality of electrical terminals on each of the first and second sets of terminals, respectively.

A cam means is coupled to the second ends of the pair of spring members positioned so as to cause the first and second curved members to maintain engagement with said plurality of electrical terminal, of said first and second sets of terminals, respectively. The cam means is adapted, when actuated, to force the contacts on said first and second curved members into engagement with the plurality of electrical terminals on the first and second circuit boards, respectively, while maintaining electrical engagement with the plurality of terminals of the first and second sets of terminals, respectively.

The novel features which are believed to be characteristic of the invention both as to its organization and its method of operation, together with further objects and advantages thereof, will be better understood from the following description in connection with the accompanying drawings in which presently preferred embodiments of the invention are illustrated by way of examples. It is to be expressly understood, however, that the drawings are for purposes of illustration and description only, and are not intended as a definition of the limits of the invention.

BRIEF DESCRIPTION OF THE DRAWINGS

Illustrated in FIG. 1 is perspective view of a housing adapted to receive the edge portions of circuit boards for electrical connection to a mother board mounted therein.

Illustrated in FIG. 2 is a cross-sectional view of a portion of the housing shown in FIG. 1 along the line 2—2.

Figure 2:
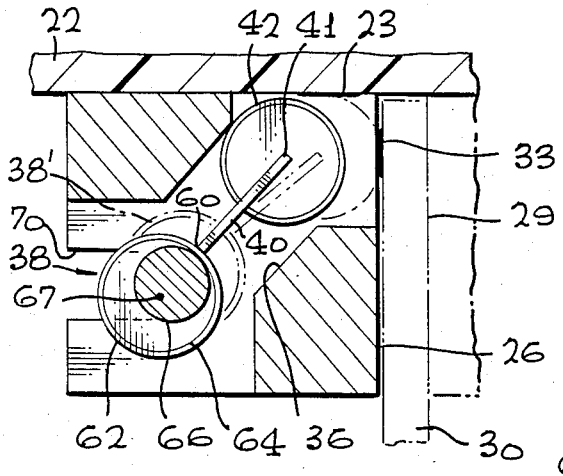
Figure 3:
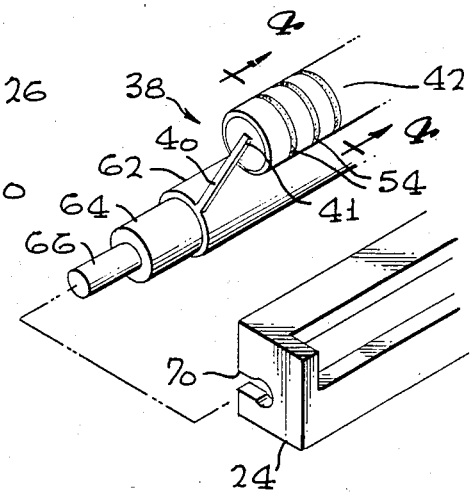

Illustrated in FIG. 3 is a partial exploded perspective view of the electrical connector and connector mounting assembly shown in FIG. 2.

Figure 4:
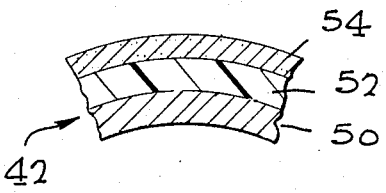

Illustrated in FIG. 4 is an enlarged partial view of the electrical connector illustrated in FIG. 3 along the line 4—4.

Illustrated in FIG. 5 is an alternate embodiment of the electrical connector shown in FIG. 2.

Illustrated in FIG. 6 is an additional embodiment of the electrical connector illustrated in FIG. 2.

Illustrated in FIG. 7 is an enlarged partial view of the end portion of the electrical connector shown in FIG. 6, particularly illustrating the deformation of the electrical contact when coupling the mother board to the circuit board.

Figure 1:
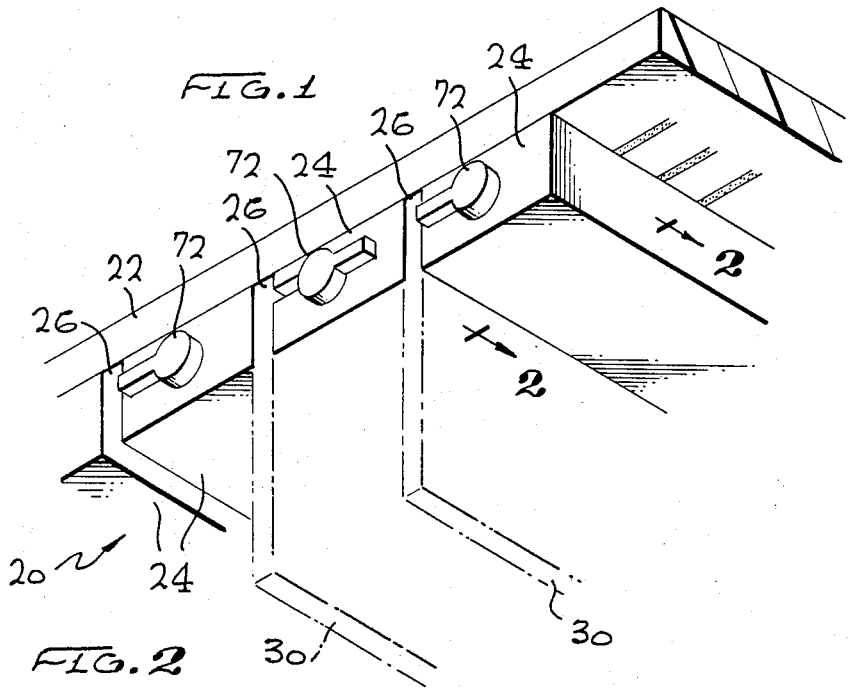

Illustrated in FIG. 8 is an additional embodiment of the housing shown in FIG. 1 wherein each electrical socket is adapted to receive a pair of circuit boards.

Illustrated in FIG. 9 is a cross sectional view of the interior of a portion of FIG. 8.

Figure 10:
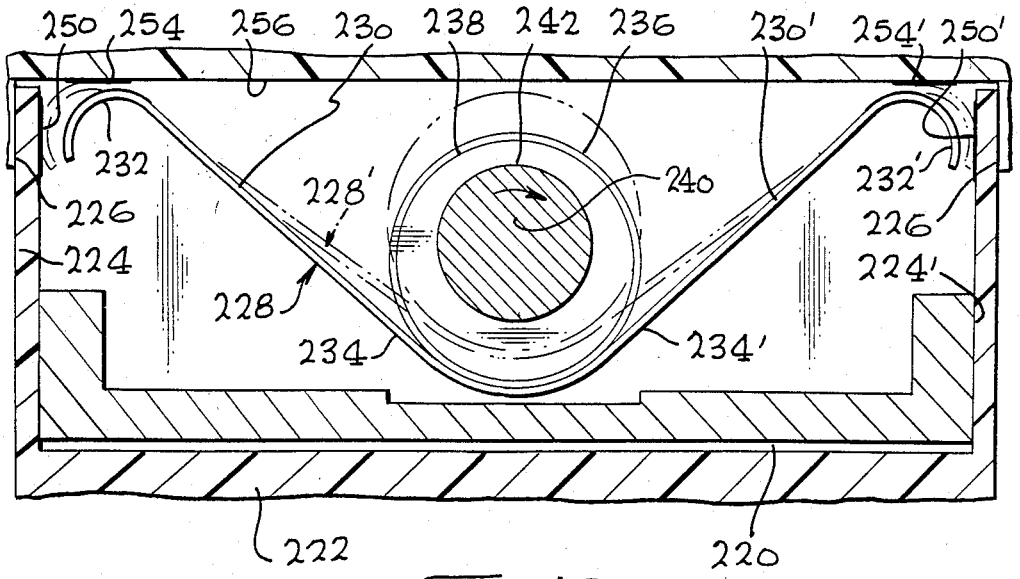

Illustrated in FIG. 10 is an alternate embodiment of the electrical connector illustrated in FIG. 9.

Figure 11:
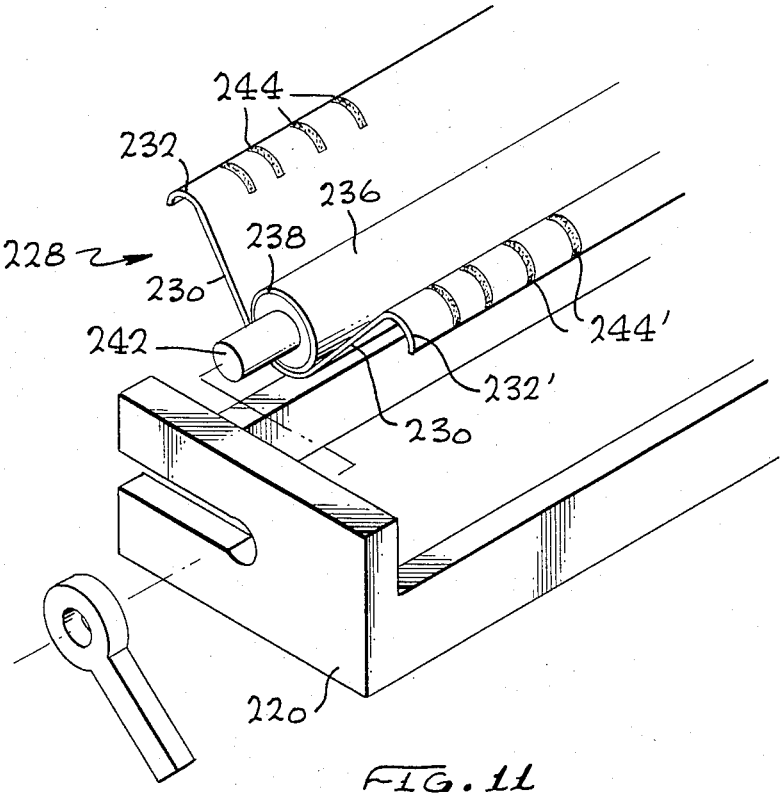

Illustrated in FIG. 11 is an exploded partial perspective view of the electrical connector illustrated in FIG. 10.

Figure 12:
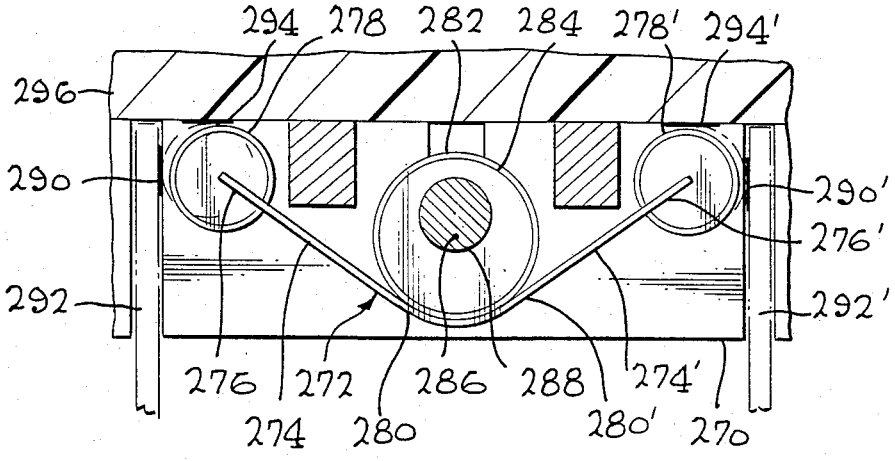

Illustrated in FIG. 12 is an alternate embodiment of the electrical connector illustrated in FIG. 9.

Figure 13:
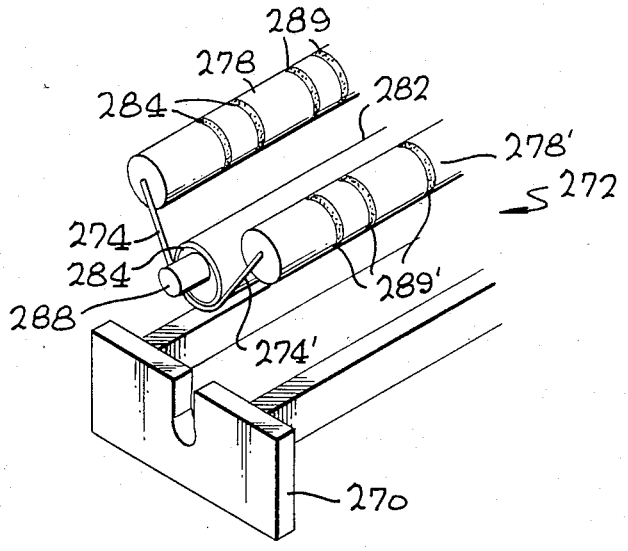

Illustrated in FIG. 13 is an exploded partial perspective view of the electrical connector illustrated in FIG. 12.

BEST MODE FOR CARRYING OUT THE INVENTION

Illustrated in FIG. 1 is a partial perspective view of a housing adapted to received printed circuit boards. Illustrated in FIG. 2 is a cross sectional view of a portion of FIG. 1 along the lines 2—2, while illustrated in FIG. 3 is an exploded perspective view of the connector assembly for electrically coupling the circuit board to the mother board.

Referring to FIGS. 1–3 it can be seen that the housing, generally designated by numeral 20, comprises a mother board 22 which typically has self-contained circuitry and is typically fabricated from a nonconductive material. The mother board 22 has typically a plurality of electrical terminals 23, only one of which is shown. Connector mounting assemblies 24 are mounted in spaced relationship on the mother board 22 forming a plurality of electrical sockets 26 which are adapted to receive the edge portions 29 of the circuit boards 30. Each circuit board 30 at its edge portion 29 incorporates a plurality of electrical terminals 33 (only one of which is shown). It should be noted that a particular circuit board or mother board could have only one or a multiplicity of electrical terminals. Thus, when the circuit boards 30 are installed into the housing 20, the electrical terminals 23 and 33 are at substantially right angles to each other.

The electrical terminals 23 and 33 (commonly called traces) are essentially electrically conductive metal strips rising above the boards approximately 0.004 inch. The spacing there beween is as compact as technically possibly. The electrical terminal 23 and 33 are connected on their underside to internal wiring (not shown). Thus, the interior of the boards are sealed from moisture or other contamination.

The connector mounting assemblies 24 each incorporate a guide channel 36 for guiding an electrical connector 38. The electrical connector 38 comprises a spring member 40 having a first end 41 terminating in a curved end, in this case a circular tube 42.

Illustrated in FIG. 4 is an enlarged cross-sectional view of a portion of the circular tube 42 along the line 4—4. The tube 42 comprises an inter spring metal member 50, preferrably made of beryllium copper, with an insulation layer 52 is bonded thereto. Preferrably this insulation layer is Mylar and at least covers a portion of the tube 42. Electrical contacts 54 are attached to the insulation layer 52 which at least extend partially about the tube 42 but always insulated by the layer 52 from the member 50.

Mounted to the second end 60 of the spring member 40 is a hollow circular shaped tube 62. Rotatably mounted within the tube 62 is a cam member 64 having supporting shafts 66 (only one is shown) which are offset from the centerline 67 of the cam member 64. The shafts 66 are rotatably mounted in slots 70 (only one is shown) of the locking assembly 24. Attached to the shaft 66 is a handle 72 which protrudes out of the housing and thus is accessible from the front of the housing.

Thus, when the handle 72 is rotated the cam member 64 causes the tube 42 to translate guided by the channel 36 maintaining slideable contact with the terminal 23 and thereafter coming into contact with the electrical terminal 33 on the circuit board 30. Note, that the position of the slot 70 and channel 36 are such that the contact 54 always remains in slideable contact with the terminal 23 with a substantial spring force.

In subsequent descriptions of various embodiments of the invention the electrical terminals on the mother board, circuit board, and the electrical contacts on the electrical connector will be referred to in the plural but it is again noted that the number could be as low as one of course, in the vast majority of situations there will be a plurality of electrical terminals and contacts.

Illustrated in FIG. 5 is an alternate embodiment of the one shown in FIG. 2. Here it can be seen that the electrical connector, generally designated as numeral 80 comprises a spring member 82 terminating at its first end 84 in a curved member 86 (semicircular in shape). The second end 88 of the spring member 82 is coupled to a hollow cylindrical tube 90. Rotatably mounted within the hollow member 90 is a cam member 92. Mounted at each end of the cam member 92 are supporting shafts 94 (only one is shown) which are in turn rotatably mounted in the locking assembly 96.

As in the previous case (FIGS. 1–4), the curved member 86 incorporates insulated electrical contacts which slideably engages first electrical terminals 100 mounted on the mother board 102. The circuit board 103 also incorporates at least one second electrical terminal 106. Incorporated into the connector mounting assembly 96 is a flange member 112 which engages the spring member 82 and tends to force the electrical contact into slideable engagement with the electrical terminal 100. Rotation of the support shaft 94 causes the electrical contact 80 to slide along the first electrical terminals 100 and into engagement with the second electrical terminals 106 on the circuit board 103. Here the guide 112 ensures that such contact is made, i.e., to the position indicated by 80' (dotted lines).

Illustrated in FIG. 6 is another alternate embodiment to that shown in FIG. 1–4. The significant difference here is that in the electrical connector, generally designated by numeral 118, the second end 120 of the spring member 122 is fastened directly to the cam member 124 by fastener 125 (only one is shown). With the support shaft 126 offset from the centerline 127 of the cam member 124, rotation thereof causes the curved member 130 at the first end 132 of the spring member 122 to move to the position indicated by numeral 122' (dotted lines) and engage the electrical terminals 140 on the circuit board 142 while maintaining slideable engagement with the electrical terminals 144 on the mother board 146. Here again a guide member 150 mounted to the connector mounting assembly 152 ensures that the electrical contacts 130 always remains in contact with terminals 144 and is driven into contact with terminals 140 with a great degree of force.

Illustrated in FIG. 7 is an enlarged view of the curved member 132 of the spring member 122 showing contacts 130 engaged with the terminals 144 of the mother board 146 and terminal 140 of the circuit board 142. Here it can be seen that the large distortion will cause a wiping action on both terminals ensuring that any oxide or contamination is wiped these said terminals producing a sound electrical connection between the two.

Illustrated in FIG. 8 is a side elevation view of an alternate embodiment of the housing illustrated in FIG. 1. Referring to FIG. 8, it can be seen that the housing, generally designated by numeral 160, comprises a mother board 162 to which are mounted a plurality of connector mounting assemblies 163 having a socket 164 adapted to receive a circuit board assembly 165. Circuit board assembly 165 has two circuit boards 166 and 167 in spaced relationship having edge portions 168 and 169, respectively, mounted in the socket 164. Note that the mother board is provided with protrusions 170 which act as guides for the circuit board assembly 165.

Illustrated in FIG. 9 is a cross sectional view of the interior of the connector mounting assembly 163. Referring to both FIGS. 8 and 9 it can be seen that the circuit boards 166 and 167 are mounted in the socket 164. An electrical connector, generally indicated by numeral 172, is mounted between the circuit boards and comprises a pair of spring members 174, 174' having their first ends terminating in curved members 176, 176', respectively, having electrical contacts mounted thereon in a manner similar to the electrical connector 82 illustrated in FIG. 5. The spring members 174 and 174' at their second ends 180 and 180', respectively, are joined together. At the center of the electrical connector 172 are a plurality of holes 182 (only one of which is shown). Mounted to the mother board 162 are a plurality of pins 190 (only one of which is shown) which extend through the holes 182. A cam member 200 is rotatably mounted to the locking assembly via shafts 202 (only one of which is shown). The cam member 200 incorporates a plurality of grooves 204 in alignment with the plurality of holes 182 and, thus, the pin 190 extends into these grooves. This ensures that the electrical connector 172 is properly located in relationship to the circuit boards. Rotation of the cam 200 forces the electrical connector to the position indicated by 172' causing the electrical contacts into engagement with the electrical terminals 206 and 206' on the circuit boards 166 and 167 while still maintaining slideable contact with the electrical terminals 208 and 208', respectively, on the mother board 162. Thus, with this embodiment a pair of circuit boards can be simultaneously secured in and electrically connected the housing.

Illustrated in FIG. 10 is a cross-sectional view similar to that shown in FIG. 9 disclosing a different embodiment of an electrical connector. Illustrated in FIG. 11 is a partial exploded perspective view of a diifferent embodiment of the electrical connector 172 shown in FIG. 9. Referring to FIGS. 10 and 11 it can be seen that the connector mounting assembly 220 supports a circuit board assembly 222 comprising circuit boards 224 and 224' which are guided into the socket 226. The electrical connector generally designated by numeral 228 comprising a pair of spring members 230 and 230'. The spring member 230 and 230' which have first ends terminating in curved members 232 and 232', respectively. These curved members 232 and 232' are similar to those disclosed in FIG. 9, in particularly, members 176 and 176'. The seconds ends 234 and 234' of spring members 230 and 230', respectively, are joined together. Coupled to the second ends 234 and 234' is a tubular member 236. Rotatable mounted within the tubular member 236 is a cam member 238 having an axis of rotation 240. Mounted on each end are support shafts 242 (only one of which are shown) which are rotatably mounted in the connector mounting assembly 220. Thus, as previously discussed, rotation of the cam member 238 causes the electrical connector 228 to move to the position 228' (indicated in dotted lines). This causes the electrical terminals 244 and 244' on the members 232 and 232' to engage the electrical terminals 250 and 250' on the circuit boards 224 and 224', respectively, while maintaining contact with the electrical terminals 254 and 254' on the mother board 256.

Illustrated in FIG. 12 is a cross sectional view of another embodiment of the electrical connector mounted within a connector mounting assembly. Illustrated in FIG. 13 is a partial exploded perspective view of the embodiment illustrated in FIG. 12. Referring to FIGS. 12 and 13 it can be seen that as in the previous example the locking assembly 270 contains an electrical connector 272, generally designated by numeral 272, having first and second spring members 274 and 274'. The first ends 276 and 276' of the spring members 274 and 274', respectively, terminate in circular tubes 278 and 278' which are identical to the one shown in FIG. 2, i.e., circular tube 42 of the electrical connector 38. Thus, a detailed description need not again be provided. The second ends 280 and 280' of the spring members 274 and 274', respectively, are coupled together and joined to a tubular member 282. Rotatably mounted within the tubular member 282 is a cam member 284 having an axis of rotation indicated by numeral 286. A pair of shafts 288 (only one of which is shown) are mounted on the end of the cam member 284 offset from the axis of rotation 286 of the cam member. Thus, when the cam member 284 is rotated the electrical contacts 289 and 289' of circular tubes 278 and 278', respectively, of the electrical connector 272 are forced into contact with electrical terminals 290 and 290' on the circuit boards 292 and 292', respectively, while maintaining electrical contact with electrical terminals 294 and 294' on the mother board 296.

While the front panel operated zero insertion force housing for printed circuit boards and the connector therefor have been described with reference to particular embodiments, it should be understood that the embodiments are merely illustrative as there are numerous variations and modifications which may be made by those skilled in the art. Thus, the invention is to be contrued as being limited only by the spirit and scope of the appended claims.

INDUSTRIAL APPLICABILITY

The front panel operated zero inseration force housing for circuit boards and the electrical connector therefor has application on electronic system and subsystems.

I claim:

1. An electrical connector for a housing having a zero insertion force electrical socket, said socket having a plurality of first electrical terminals and further adapted to receive an edge portion of a printed circuit board, said circuit board having a plurality of second electrical terminals mounted thereon, in a manner such that when said circuit board is installed in said socket, said plurality of first electrical terminals is at substantially right angles to said plurality of second electrical terminals, said electrical connector comprising:

a spring member, having first and second ends positioned within said housing along said plurality of first electrical terminals, said first end terminating in a curved member having a plurality of electrical contacts in slideable engagement with said plurality of first terminals; and a cam means, rotatably mounted within the housing, and attached to said second end of said spring member positioned so as to cause said spring member to maintain said plurality of electrical contacts in slideable engagement with said plurality of first electrical terminals and adapted, when actuated, to force said plurality of electrical contacts into engagement with said plurality of second electrical terminals on said circuit board while maintaining electrical contact with said plurality of first electrical terminals.

2. The electrical connector as set forth in claim 1 wherein the cross section of said curved member is semicircular in shape.

3. The electrical terminal as set forth in claim 2 wherein said housing incorporates guide means adapted to guide said semicircular member into contact with said plurality of second electrical terminals.

4. The electrical connector as set forth in claim 3 wherein said guide means is a plate mounted in said housing and said spring member is in slideable contact with said plate.

5. The electrical connector as set forth in claim 1 wherein said cross section of said first end of said spring member is circular in shape.

6. The electrical connector as set forth in claim 5 including guide means adapted to guide said first end of said spring member into contact with said plurality of second electrical terminals on said circuit board.

7. The electrical connector as set forth in claim 6 wherein said guide means is a channel located in said housing adapted to guide said circular shaped second end.

8. The electrical connector as set forth in claims 1 or 2 or 3 or 4 or 5 or 6 or 7 wherein said cam means comprises:

a hollow tubular member attached to said second end of said spring member;

a cam member rotatably mounted within said hollow tubular member; and a pair of support shafts attached to each end of said cam member and both rotatably mounted to said housing, said support shafts having an axis of rotation offset from the center of said cam member;

such that when said shafts are rotated said cam member forces said spring member toward and into contact with said plurality of second electrical terminals on said circuit board.

9. The electrical connector as set forth in claim 8 wherein said spring member comprises:

a flat sheet type spring;

an insulation coating joined to said flat sheet type spring covering at least a portion of said curved member; and a conductive material joined to said insulation coating forming said plurality of electrical contacts.

10. The electrical connector as set forth in claim 9 wherein said flat sheet type spring is made of beryllium copper, said insulation coating is Mylar and said at least one contact is copper.

11. The electrical connector as set forth in claim 10 including:

one of said pair of support shafts extending out of said housing at the entrance to said socket; and a handle attached to said support shaft adapted to rotate said cam member.

12. An electrical connector for a housing having a zero insertion force electrical socket, said socket having first and second sets of electrical terminals in spaced relationship, each of said sets having plurality of electrical terminals therein, said socket adapted to receive the edge portion of first and second circuit boards in spaced relationship, each of said circuit boards having plurality of electrical terminals, in a manner such that when said first and second circuit boards are installed in said socket said first set of electrical terminals is at substantially right angles to said plurality of electrical terminals of said first circuit board and the second set of electrical terminals is at substantially right angles to said plurality of terminals on said second circuit board, the electrical connector comprising:

a pair of spring members mounted between said first and second sets of terminals having first and second ends, said first ends of each of said spring members coupled together and said second ends of said first and second spring members terminating in first and second curved members, respectively, having a plurality of electrical contacts in slideable engagement with said plurality of terminals of said first and second sets, respectively; and cam means coupled to said first ends of said first and second spring members positioned so as to cause said first and second spring members to maintain said plurality of electrical contacts in slideable engagement with said plurality of electrical terminals of said first and second sets and adapted when actuated, to force said plurality of said contacts into engagement with said plurality of terminals on said first and second circuit boards, respectively, while maintaining electrical contact with said plurality of terminals of said first and second sets of terminals, respectively.

13. The electrical connector as set forth in claim 12 wherein the cross-section of said curved members of said first and second spring members is semicircular in shape.

14. The electrical connector as set forth in claim 12 wherein said cross section of said curved members of said first and second spring members is circular in shape.

15. The electrical connector as set forth in claim 12 or 13 or 14 wherein said cam means comprises:

a hollow tubular member attached to said first ends of said first and second spring members;

a cam member rotatably mounted within said hollow tubular member;

a pair of support shafts attached to each end of said cam member and both rotatably mounted in said housing, having an axis of rotation offset from the center of said cam member.

16. The electrical connector as set forth in claims 12 or 13 or 14 wherein said first ends of said spring members are joined directly together and said cam means comprises:

a cam member rotatably mounted within said housing adapted to, when rotated, to contact said joined first ends and to force said second ends of said first and second spring members into contact with said plurality of electrical terminals on said first and second circuit boards, respectively, while maintaining slideable contact with said plurality of terminals of said first and second sets of terminals, respectively.

17. The electrical connector as set forth in claim 16 wherein:

said joined spring members having a plurality of spaced apertures along its length;

said cam member having a plurality of grooves in alignment with said plurality of apertures; and a plurality of guide pins mounted to said housing and extending through said plurality of apertures in said joined spring members and extending into said plurality of grooves.

18. A circuit board housing for electrically coupling at least one circuit board to a mother board mounted within said housing, said housing comprising:

said housing having at least one zero insertion force socket, said socket in communication with a portion of the mother board, said portion of said mother board having a plurality of first electrical terminals mounted thereon, said at least one socket adapted to receive an edge portion of said at least one circuit board, said at least one circuit board having a plurality of second electrical terminals mounted thereon, in a manner such that when said at least one circuit board is installed in said at least one socket, said plurality of first electrical terminals on said mother board are at substantially right angles to said plurality of second electrical terminals;

an electrical connector comprising:

a spring member having first and second ends, said first end terminating in a curved member having a plurality of electrical contacts mounted thereon, said plurality of electrical contacts in slideable engagement with said plurality of first electrical terminals; and a cam means mounted on said second end of said spring member positioned so as to cause said spring member to maintain said plurality of first electrical contacts in slideable engagement with said plurality of first electrical terminals and adapted, when actuated, to force said plurality of electrical contacts into engagement with said plurality of second electrical terminals and maintaining engagement with said plurality of first electrical terminals.

19. The circuit board housing as set forth in claim 18 wherein the cross section of said curved member is semicircular in shape.

20. The circuit board housing as set forth in claim 19 wherein said housing incorporates guide means adapted to guide said semicircular member into contact with said plurality of second electrical terminals.

21. The circuit board housing as set forth in claim 20 wherein said guide means is a plate mounted in said housing and with said spring member in slideable contact therewith.

22. The circuit board housing as set forth in claim 18 wherein said cross section of said first end of said spring member is circular in shape.

23. The circuit board housing as set forth in claim 22 including guide means adapted to guide said first end of said spring member into contact with said plurality of second electrical terminals on said circuit board.

24. The circuit board housing as set forth in claim 23 wherein said guide means is a channel located in said housing adapted to guide said circular shaped second end.

25. The circuit board housing as set forth in claims 18 or 19 or 20 or 21 or 22 or 23 or 24 wherein said cam means comprises:

a hollow tubular member attached to said second end of said spring member;

a cam member rotatably mounted within said hollow tubular member; and a pair of support shafts attached to each end of said cam member and both rotatably mounted in said housing having an axis of rotation offset from the center of said cam member;

such that when said shafts are rotated said cam member forces said spring member toward and into contact with said plurality of second electrical terminals on said circuit board.

26. The circuit board housing as set forth in claim 25 wherein said spring member comprises:

a flat sheet type spring;

an insulation coating joined to said flat sheet type spring covering at least a portion of said curved member; and a conductive material joined to said insulation coating forming said plurality of electrical contacts.

27. The circuit board housing as set forth in claim 26 wherein said flat plate type spring is made of beryllium copper, said insulation coating is Mylar and said plurality of contacts are copper.

28. The circuit board housing as set forth in claim 27 including:

one of said pair of support shafts extending out of said housing at the entrance to said socket; and a handle attached to said support shaft adapted to rotate said cam member.

29. A circuit board housing for electrically coupling at least two circuit boards to a mother board mounted within said housing, said housing comprising:

said housing having at least one zero insertion force socket, said socket in communication with a portion of the mother board, said portion of the mother board having first and second sets of electrical terminals in spaced relationship, each of said sets having at plurality of electrical terminals, said at least one socket adapted to receive the edge portion of first and second circuit boards in spaced relationship, each of said circuit boards having a plurality of electrical terminals thereon, in a manner such that when said first and second circuit boards are installed in said at least one socket said first set of electrical terminals on said mother board is at substantially right angles to said plurality of electrical terminals of said first circuit board and the said second set of said electrical terminals on said mother board are at substantially right angles to said plurality of electrical terminals on said second circuit board, a pair of spring members mounted between said first and second sets of terminals having first and second ends, said first ends of each of said spring members coupled together and said second ends of said first and second spring members terminating in curved members having a plurality of electrical contacts in slideable engagement with said plurality of electrical terminals on said first and second sets, respectively; and cam means coupled to said first ends of said first and second members positioned so as to cause said first and second spring members to maintain said plurality of electrical contacts in slideable engagement with said plurality of electrical terminals on said first and second sets and adapted, when actuated, to force said plurality of electrical contacts into engagement with said plurality of electrical terminals on said first and second circuit boards, respectively, while maintaining electrical engagement with said plurality of terminals of said first and second sets of terminals, respectively.

30. The circuit board housing as set forth in claim 29 wherein the cross section of said curved members of said first and second spring members is semicircular in shape.

31. The circuit board housing as set forth in claim 29 wherein said cross section of said curved members of said first and second spring members is circular in shape.

32. The circuit board housing as set forth in claim 29 or 30 or 31 wherein said cam means comprises:

a hollow tubular member attached to said first ends of said first and second spring members;

a cam member rotatably mounted within said hollow tubular member;

a pair of support shafts attached to each of said cam member and both rotatably mounted in said housing, having a axis of rotation offset from the center of said cam member.

33. The circuit board housing as set forth in claims 29 or 30 or 31 or wherein said first ends of said spring members are joined directly together and said cam means comprises:

a cam member rotatably mounted within said housing adapted to, when rotated, to contact said joined first ends and to force said second ends of said first and second spring members into contact with said plurality of electrical terminals of said first and second circuit boards, respectively, while maintaining slideable contact with said plurality of terminals on said first and second sets of terminals, respectively.

34. The circuit board housing as set forth in claim 33 wherein:

said joined spring members having a plurality of apertures along its length;

said cam member having a plurality of grooves in alignment with said plurality of apertures; and a plurality of guide pins mounted to said housing and extending through said plurality of apertures in said joined spring members and into said plurality of grooves.

* * * * *